US008302436B2

(12) United States Patent
Cheung

(10) Patent No.: US 8,302,436 B2
(45) Date of Patent: Nov. 6, 2012

(54) LINKAGE LOCK

(75) Inventor: Mei Ling Cheung, New Taipei (TW)

(73) Assignee: Sinox Co., Ltd., New Taipei (TW)

( * ) Notice: Subject to any disclaimer, the term of this patent is extended or adjusted under 35 U.S.C. 154(b) by 0 days.

(21) Appl. No.: 13/331,832

(22) Filed: Dec. 20, 2011

(65) Prior Publication Data

US 2012/0151973 A1 Jun. 21, 2012

Related U.S. Application Data

(60) Provisional application No. 61/424,828, filed on Dec. 20, 2010.

(51) Int. Cl.
*E05B 67/06* (2006.01)

(52) U.S. Cl. ..... 70/49; 70/14; 70/18; 70/30; 70/58; 70/233

(58) Field of Classification Search ..... 70/14, 18, 70/19, 30, 49, 58, 233
See application file for complete search history.

(56) References Cited

U.S. PATENT DOCUMENTS

| | | | | |
|---|---|---|---|---|
| 3,906,758 | A * | 9/1975 | Hurwitt | 70/30 |
| 3,959,995 | A * | 6/1976 | Fletcher | 70/18 |
| 4,760,718 | A * | 8/1988 | Muramatsu et al. | 70/18 |
| 5,475,993 | A * | 12/1995 | Kuo | 70/18 |
| 5,913,906 | A * | 6/1999 | Strocchi | 70/18 |
| 6,044,669 | A * | 4/2000 | Levi | 70/18 |
| 6,125,669 | A * | 10/2000 | McDaid et al. | 70/58 |
| 6,820,448 | B1 * | 11/2004 | Hsieh | 70/18 |
| 7,624,605 | B2 * | 12/2009 | Vitali | 70/233 |
| 7,712,339 | B2 | 5/2010 | Hentschel et al. | |
| 2005/0223756 | A1 * | 10/2005 | Ling et al. | 70/30 |
| 2005/0235710 | A1 * | 10/2005 | Ling | 70/58 |
| 2011/0219829 | A1 * | 9/2011 | Trunek | 70/58 |

FOREIGN PATENT DOCUMENTS

TW M350495 10/1997

* cited by examiner

*Primary Examiner* — Suzanne Barrett
(74) *Attorney, Agent, or Firm* — Schmeiser Olsen & Watts LLP

(57) ABSTRACT

A linkage lock comprises a lock body, a linkage chain, and a lock mechanism arranged in the lock body. The linkage chain is formed via linking a plurality of link plates and has a first end joined with the lock body and a second end able to be inserted into and secured to a socket of the lock body. The lock body has a shaft. When intending to collect the linkage lock whose second end is unlocked, the user winds the linkage chain around the surface of the shaft with the shaft being a central axis to fold the linkage lock.

9 Claims, 4 Drawing Sheets

LINKAGE LOCK

BACKGROUND OF THE INVENTION

1. Field of the Invention

The present invention relates to a linkage lock comprising a lock body and a linkage chain wound around the lock body to reduce the volume of the lock.

2. Description of the Related Art

A U.S. Pat. No. 7,712,339 disclosed a joint rod lock, which comprises a lock body and a joint bar hoop formed via linking a plurality of bars, and which can be folded together to reduce the volume thereof when collected. A Taiwan patent No. M350495 also disclosed a similar lock.

Compared with the conventional U-shape padlocks having a bulky volume, the abovementioned linkage locks indeed have reduced size. However, the abovementioned prior arts still have room to improve. For example, the appearance of the collapsed locks should be taken in consideration in design in addition to volume reduction.

SUMMARY OF THE INVENTION

The primary objective of the present invention is to provide a linkage lock having small folded size, particularly a linkage lock having exquisite appearance when folded.

To achieve the abovementioned objective, the present invention proposes a linkage lock comprising a lock body having a socket;

a linkage chain containing a plurality of link plates and having a first end and a second end, wherein the first end is joined with the lock body, and wherein the second end can be inserted into and secured to the socket; and a lock mechanism arranged in the lock body and locking the second end when the second end has been inserted into the socket, wherein the lock body has a shaft, and wherein the linkage chain can be wound around the shaft when the second end is unlocked.

Thereby, the linkage lock of the present invention not only has a small folded size but also has a novel appearance when folded.

In one embodiment, the lock body has a first end cover and a second cover respectively arranged on two ends of the shaft.

In one embodiment, the link plates are pivotally linked one after one.

In one embodiment, the link plates are pivotally linked one over one.

In one embodiment, the shaft has a cylindrical shape, and the link plates have arc-shape recessions corresponding to the shape of the shaft.

In one embodiment, the lock mechanism is a key-operated lock mechanism or a combination lock mechanism.

In one embodiment, the lock mechanism has a latch. After the second end is inserted into the socket, the latch can be operated to lock the second end at the locking position of the lock body. When the second end is at the locking position of the lock body, the latch can be operated to an unlocking position to release the second end.

In one embodiment, the second end has a hole. After the second end has been inserted into the socket, the latch can be operated to pass through the hole to lock the second end.

In one embodiment, the lock body and the second end respectively have a positioning block and a positioning hole. When the linkage chain has been wound around the lock body, the positioning block engages with the positioning hole.

In one embodiment, the linkage chain, which has been wound around the shaft, presents a cylindrical shape or a polygonal column shape.

DETAILED DESCRIPTION OF THE INVENTION

The technical contents of the present invention are demonstrated with embodiments below.

Figure 1:
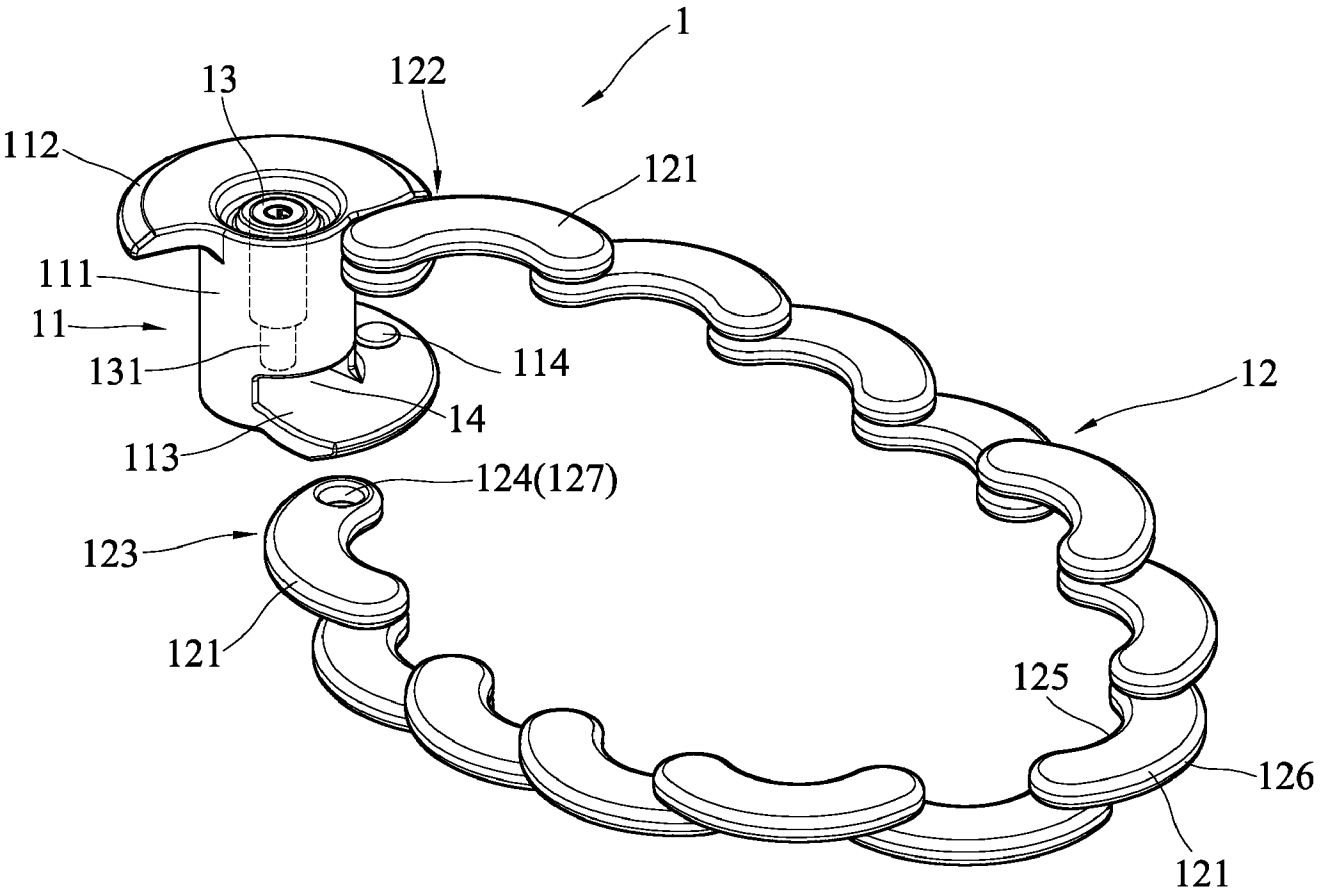
FIG. 1 is a perspective view schematically showing that an unfolded linkage chain has not been locked to a lock body according to one embodiment of the present invention.

Refer to FIG. 1. The linkage lock 1 of the present invention comprises a lock body 11, a linkage chain 12 and a lock mechanism 13 arranged in the lock body 11. The lock body 11 has a shaft 111. The lock body 11 also has a first end cover 112 and a second end cover 113 respectively arranged at two ends of the shaft 111. The lock body 11 also has a socket 14 at a position where the second end cover 113 is joined with the shaft 111.

The linkage chain 12 is formed via linking a plurality of link plates 121. In one embodiment, the link plates 121 are pivotally linked one after one and one over one. The length of the linkage chain 12 depends on the length of each link plate 121 and the number of the link plates 121. The linkage chain 12 has a first end 122 and a second end 123. The first end 122 is joined to the lower side of the first end cover 112 of the lock body 11. The second end 123 can be inserted into the socket 14. The second end 123 has a hole 124. After the second end 13 has been inserted into the socket 14, a latch 131 of the lock mechanism 13 can be operated to pass through the hole 124 to lock the second end 123.

Figure 2:
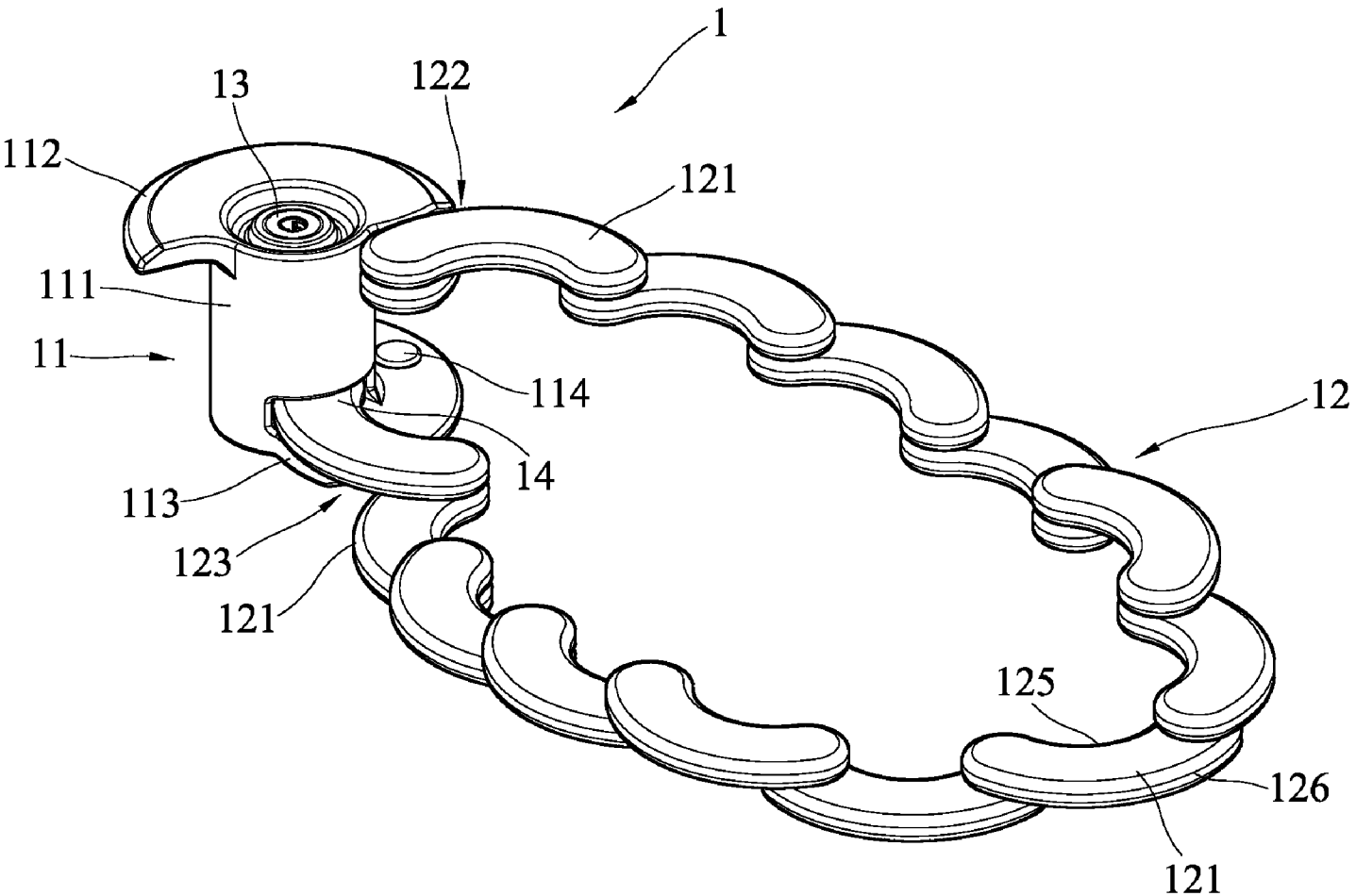
FIG. 2 is a perspective view schematically showing that a linkage chain has been locked to a lock body according to one embodiment of the present invention.

Refer to FIG. 2. The lock mechanism 13 arranged in the lock body 11 has a latch 131. After the second end 123 of the linkage chain 12 has been inserted into the socket 14 of the lock body 11, the user can use the lock mechanism 13 to operate the latch 131 to pass through the second end 123 and lock the latch 131 at a locking position of the lock body 11. When the second end 123 is at the locking position of the lock body 11, the user can use the lock mechanism 13 to operate the latch 131 to an unlocking position to release the second end 123. In the embodiment shown in the drawings, the lock mechanism 13 is exemplified by a key-operated lock mechanism. In another embodiment, the lock mechanism 13 may be a combination lock mechanism.

Figure 3:
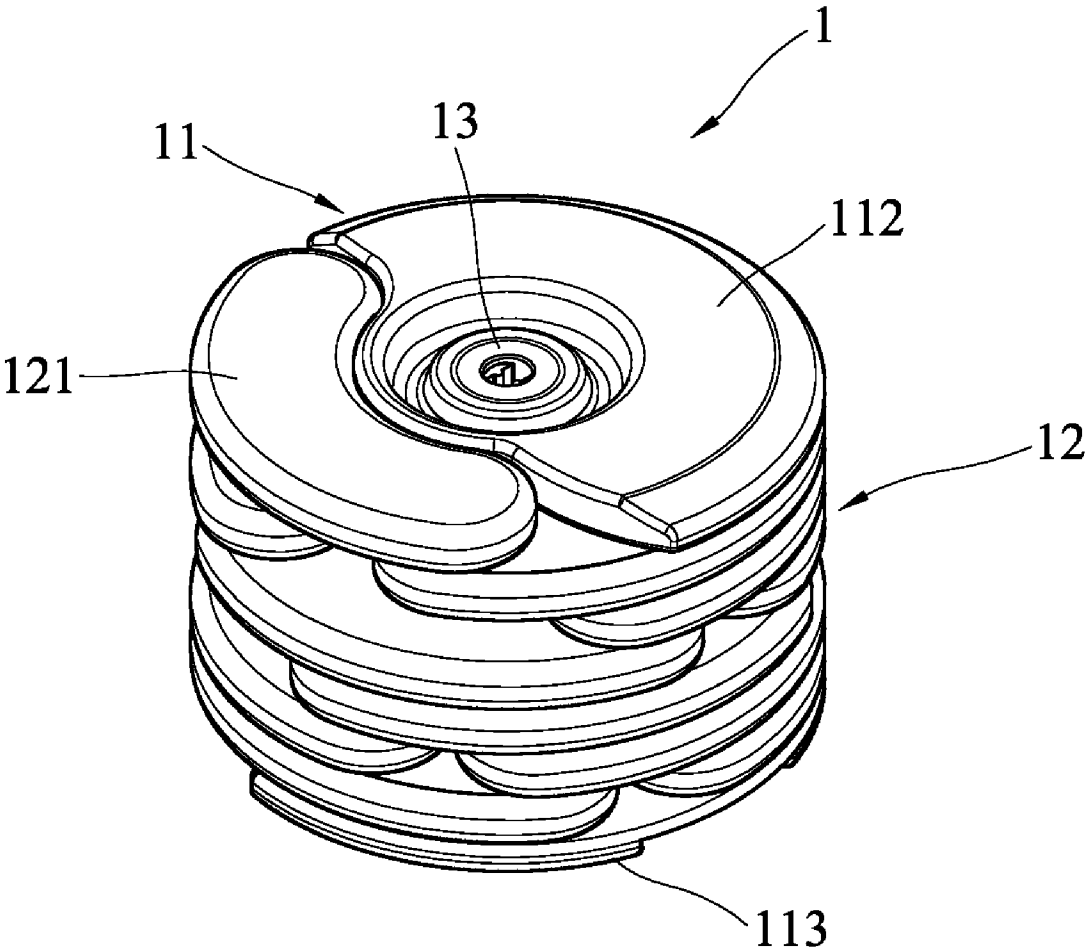
FIG. 3 is a perspective view schematically showing that a linkage chain has been wound around a lock body according to one embodiment of the present invention.

Refer to FIG. 3. The link plates 121 have an arc shape. When intending to collect the linkage lock 1 whose second end 123 has been released, the user winds the linkage chain 12, which is formed of a plurality of link plates 121, around the surface of the shaft 111 with the shaft 111 being a central axis to fold the linkage lock 1.

As shown in FIG. 3, the folded linkage lock 1 presents a cylindrical shape, which is distinct from the shapes of the conventional linkage locks. Therefore, the linkage lock 1 of the present invention can be folded to have a smaller size and present an exquisite appearance. However, the present invention does not constrain that the folded linkage lock 1 must have a cylindrical shape. In other embodiments, the appearance of the folded linkage lock 1 may have different shapes, such as a polygonal column shape, depending on the shapes of the lock body 11 and the linkage chain 12.

Figure 4:
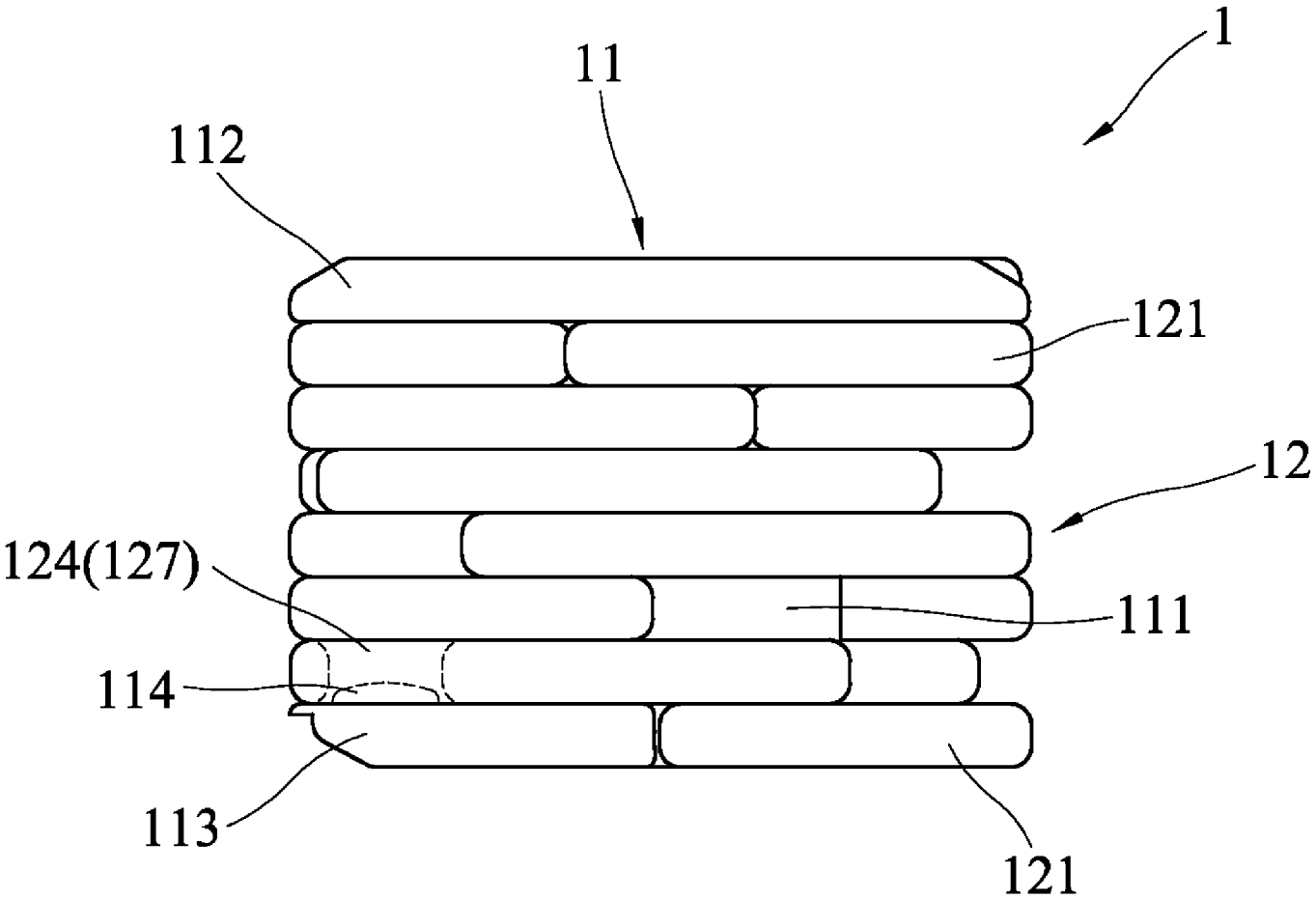
FIG. 4 is a side view schematically showing a folded linkage lock according to one embodiment of the present invention.

The second end cover 113 of the lock body 11 and the second end 123 of the linkage chain 12 respectively have a positioning block 114 and a positioning hole 127. When the linkage chain 12 has been wound around the lock body 11, the positioning block 114 engages with the positioning hole 127, whereby the second end 123 of the linkage chain 12 is secured to the second end cover 113 of the lock body 11, as shown in FIG. 4. Such a design can prevent the linkage chain 12 detaching from the lock body 1 and keep the folded linkage lock 1 having the appearance shown in FIG. 3.

The embodiments described above are only to exemplify the present invention but not to limit the scope of the present invention. Any equivalent modification or variation according to the spirit of the present invention is to be also included within the scope of the present invention.

What is claimed is:

1. A linkage lock comprising a lock body having a socket;

a linkage chain formed via linking a plurality of link plates and having a first end and a second end, wherein said first end is joined with said lock body, and wherein said second end can be inserted into and secured to said socket; and a lock mechanism arranged in said lock body and locking said second end when said second end has been inserted into said socket, wherein said lock body has a shaft, and wherein said linkage chain can be wound around said shaft when said second end is unlocked, wherein said lock body and said second end respectively have a positioning block and a positioning hole, and wherein when said linkage chain has been wound around said lock body, said positioning block engages with said positioning hole.

2. The linkage lock according to claim 1, wherein said lock body has a first end cover and a second cover respectively arranged on two ends of said shaft.

3. The linkage lock according to claim 1, wherein said link plates are pivotally linked.

4. The linkage lock according to claim 3, wherein said link plates are pivotally linked one over one.

5. The linkage lock according to claim 3, wherein said shaft has a cylindrical shape, and wherein said link plates have arc-shape recessions corresponding to shape of said shaft and able to contact surface of said shaft closely.

6. The linkage lock according to claim 1, wherein said lock mechanism is a key-operated lock mechanism or a combination lock mechanism.

7. The linkage lock according to claim 1, wherein said lock mechanism has a latch, wherein after said second end is inserted into said socket, said latch can be operated to lock said second end at a locking position of said lock body, and wherein when said second end is at said locking position of said lock body, said latch can be operated to an unlocking position to release said second end.

8. The linkage lock according to claim 7, wherein said second end has a hole, and wherein after said second end has been inserted into said socket, said latch can be operated to pass through said hole to lock said second end.

9. The linkage lock according to claim 1, wherein said linkage chain, which has been wound around said shaft, presents a cylindrical shape or a polygonal column shape.

* * * * *